US006656036B1

(12) United States Patent
Quigley

(10) Patent No.: US 6,656,036 B1
(45) Date of Patent: Dec. 2, 2003

(54) AIR DIRECTING VANE AND METHOD

(75) Inventor: John Patrick Quigley, Watertown, WI (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/154,787

(22) Filed: May 28, 2002

(51) Int. Cl.[7] ..... F24F 7/00
(52) U.S. Cl. ..... 454/185; 126/21 A; 126/19 R
(58) Field of Search ..... 454/57, 58, 185; 126/19 R, 21 R, 21 A

(56) References Cited

U.S. PATENT DOCUMENTS 3,261,650 A * 7/1966 Stromqvist ..... 312/236
3,366,432 A * 1/1968 Carmer ..... 312/236
3,603,380 A * 9/1971 Corhanidis ..... 165/42
3,978,843 A * 9/1976 Durth ..... 126/21 A
4,109,636 A * 8/1978 Burge ..... 126/21 A
4,126,775 A * 11/1978 Wyatt ..... 219/400
4,515,143 A * 5/1985 Jabas ..... 126/21 A
5,129,384 A * 7/1992 Parks ..... 126/21 A
5,423,248 A * 6/1995 Smith et al. ..... 99/443 C
5,533,444 A * 7/1996 Parks ..... 99/476
5,851,143 A * 12/1998 Hamid ..... 454/57

* cited by examiner

*Primary Examiner*—Derek Boles
(74) *Attorney, Agent, or Firm*—Baker & Hostetler, LLP

(57) ABSTRACT

An apparatus for use with a porous fluid discharge wall includes at least one vane member located proximate a discharge side of the wall to direct discharged fluid in a predetermined direction.

25 Claims, 4 Drawing Sheets

AIR DIRECTING VANE AND METHOD

FIELD OF THE INVENTION

The invention pertains to apparatus and methods for handling the flow of fluids such as air. More particularly, the invention relates to the use of air turning vanes with a porous surface where air is discharged from a plenum into, e.g., an internal volume. Even more particularly, the invention relates in some embodiments to the use of air turning vanes on a discharge plenum wall of an environmentally controlled cabinet, such as on an oven's discharge plenum wall having discharge parts.

BACKGROUND OF THE INVENTION

In many circumstances, for example in some industrial applications, a porous wall is provided where a fluid such as air is flowing in a first direction on a first side of the wall and the fluid passes through the porous wall and exits the other side of the wall in a second direction which may be different from the first direction. For example, many types of environmental chamber units are known in which a fluid such as air is circulated into and out of an internal volume in order to treat components that are placed within the internal volume. For example, in the case of a convection oven, it has been known for the convection oven to include an outer cabinet surrounding an enclosure defining an internal volume area formed by a lower wall, and upper wall, and four side walls. In such convection ovens, it is common for one side wall to be a porous air inlet wall and another side wall to be a porous air return wall. The inlet wall may have supply plenum and a plurality of air supply ports, such as evenly spaced round holes, that supply air to the internal volume. The air then flows through the internal volume and returns via the porous return wall to an air return plenum located on the other side of the wall. Often, this air return plenum has a constant vertical cross-sectional area and extends all or substantially all the height and width of the side wall. Air is drawn vertically down through the air return plenum into a plenum, such as for example a substantially horizontal lower plenum, which includes some type of fan or blower element that pressurizes the air towards a discharge plenum.

The discharge plenum is typically a vertical plenum on the air inlet wall opposite to the air return side wall, and extends upwardly outside of the air inlet wall. In some instances, the air discharge plenum will have a constant cross-section similar to the air return plenum. It has been found that in these situations that the air will discharge out of the discharge plenum openings at a some what upward angle. That is, the air does not exit through the discharge plenum openings completely horizontally, but rather exits at a discharge angle, which may, for example, be 45° upwards.

Having an upward angle component to the discharge direction is disadvantageous because a greater amount of heated discharge air tends to be forced into the upward region of the interior volume. At the same time, the heated discharge air tends not to flow past the lower portions of the interior volumes. This provides a significant disadvantage because items to be heated that are placed in the upper part of the discharge volume tend to receive a greater heat load than those in the lower part of the internal volume. Thus, it is difficult to provide an even heat transfer to parts located in different vertical areas of the interior volume.

One approach to solving this problem has been the use of a substantially horizontal porous baffle located at one or more heights inside the discharge plenum, for example, approximately midway up the height of the discharge plenum. Such a horizontal internal baffle will cause the row of discharge jets located just below the baffle to emit a particularly strong discharge jet. The strong discharge jet can be located to help even out the internal temperature profile of the oven to some extent. However, the use of a porous baffle still does not provide a completely even temperature profile and does not completely overcome the above problems.

Another partial solution has been to provide the plenum with a gradually decreasing cross-section along its height. Near the lower part of the plenum, the plenum has a relatively large cross section. The plenum wall opposite the plenum discharge wall is angled so that the interior cross sectional area of the plenum is relatively small near the top of the plenum.

With a constant cross sectional discharge plenum area, the discharge jet angle near the top is more than the discharge jet angle at the bottom. That is, for a vertical plenum with upwardly flowing air, the discharge jets are more horizontal at the top than the bottom. However, with either constant or decreasing plenum cross-sections, the jet still are emitted at an angle, and there is a tendency for the lower portion of the internal volume to be cooler because a heated jet is not directed horizontally towards that area.

Yet another partial solution to the problem of vertical components to the discharge angle has been to shrink the size and/or number of the holes so that the plenum wall has a relatively smaller total open area for discharge. This provides a larger more horizontal discharge angle. However, it has the disadvantage that the volumetric flow rate is reduced because of a high pressure drop across the supply plenum wall.

Accordingly, there is a need in the art for a method and apparatus for directing fluid discharge from porous walls so that the fluid may be directed in a particular direction. There is an even more specific need in the art for methods and apparatuses for directing air that is exiting a porous plenum wall so that it can be directed in a predetermined direction, for example substantially perpendicular to the plenum wall from which it is exiting. Moreover, there is a need in the art for a method and apparatus that is relatively easy and inexpensive to manufacture and install.

SUMMARY OF THE INVENTION

The above disadvantages are overcome at least to a great extent by embodiments of the present invention, which provides in some embodiments a method and apparatus for directing a fluid such as air which is exiting from a porous plenum wall.

In one aspect, the invention provides an apparatus for use with a porous wall having a first side and a second side, with a fluid flowing on the first side generally in a first direction. The apparatus comprises: at least one vane member located proximate to the second side of the discharge wall and having a profile that directs the discharge air from the second side in a second direction.

In another aspect, the invention provides an air handling apparatus having a plenum containing fluid moving in a first direction; a porous plenum wall permitting said flow from the plenum through the plenum wall to exit the plenum via an exit side; and at least one vane member located on said exit side of the plenum wall that directs exiting fluid flow in a predetermined second direction.

In another aspect, the invention provides an apparatus for use with a porous wall having a first side and a second side, with a fluid flowing on the first side generally in a first direction, the apparatus comprising: means located proximate the second side of the discharge wall or directing the discharge air from the second side in a second direction; and means for supporting said directing means.

In another aspect the invention provides a method for use with a porous wall having a first side and a second side, including the steps of: directing a fluid on the first side generally in a first direction; and directing discharge air from the second side in a second direction using at least one vane member.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings.

The invention is capable of other embodiments and of being practiced and carried out in various ways. Also, it is to be understood that the phraseology and terminology employed herein, as well as the abstract, are for the purpose of description and should not be regarded as limiting. As such, those skilled in the art will appreciate that the conception upon which this disclosure is based may readily be utilized as a basis for the other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
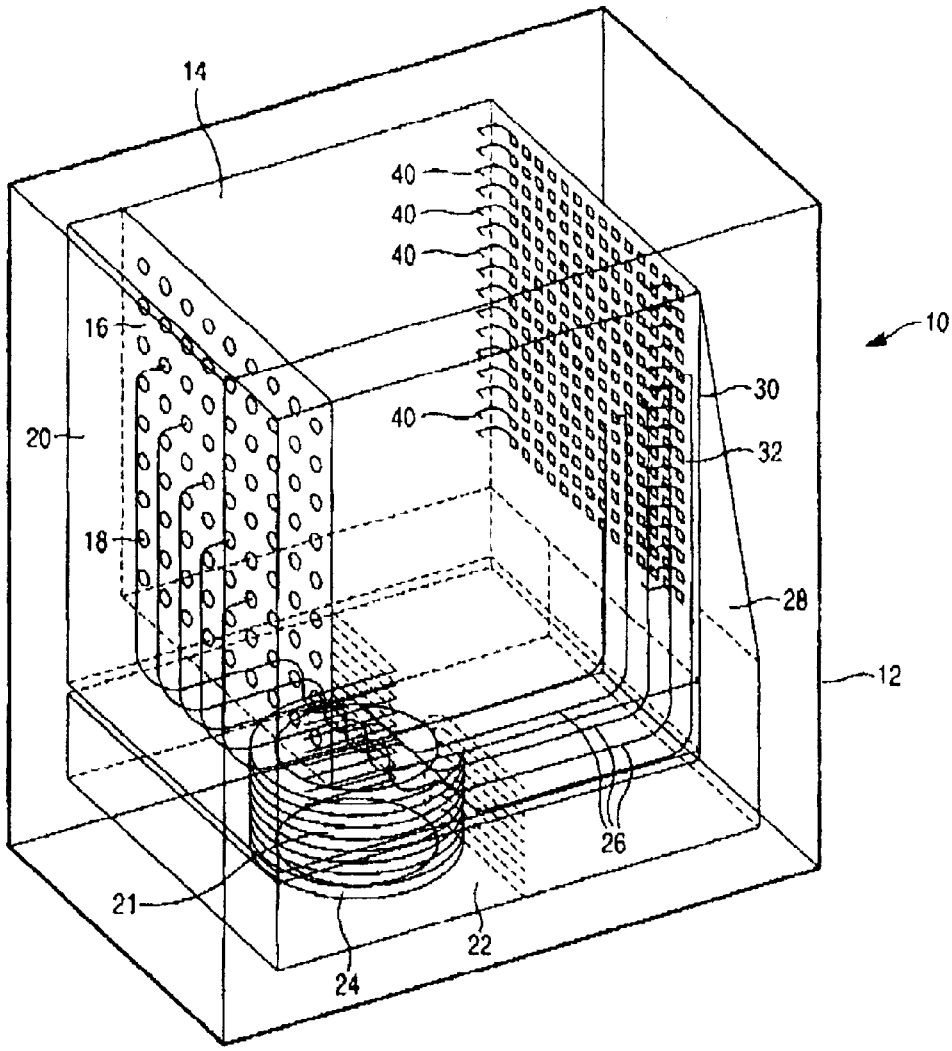
FIG. 1 is an engineering diagram showing in isometric view a convention oven having a plurality of turning vanes installed.

Turning now to FIG. 1, an environmental unit such as an oven 10 is illustrated. While the preferred embodiment depicted involves the handling of air in an oven an oven, it will be appreciated that the invention is suitable for directing other fluids, and may be used with air or other fluids in a wide variety of applications besides ovens or environmental units. For example, the invention may be suitable wherever a plenum discharge wall having one or more apertures therein is present.

The oven 10 in FIG. 1 includes an outer cabinet 12 and an internal volume 14 defined by a top wall, a bottom wall, and four side walls. One of these side walls is a return plenum side wall 16 that has a number of return ports or openings 18 provided thereon. The return plenum 20 is a generally vertically oriented plenum having a substantially uniform cross section along its vertical height, although it can also have a varying cross section. Air is drawn through the return ports 18 into the return plenum 20, and passes downwardly towards a first lower plenum 21 and through an opening into a second lower plenum 22. The second lower plenum 22 has a blower scroll 24 providing air flow 26 towards and into a generally vertically oriented discharge plenum 28. The discharge plenum 28 has on one side a discharge side wall 30, which is porous in that it has a plurality of discharge ports, or openings, 32 spaced thereon.

While in the embodiment depicted, the return side wall 16 and the discharge side wall 30 are opposed generally vertical walls of an oven interior, the invention is applicable with discharge openings that may be located in other arrangements, and with other fluid flow arrangements. For example, in some embodiments the return and/or discharge walls might not be vertical and might be horizontal or disposed at some other angle. Further, while in the depicted embodiment the blower scroll 24 is located in a lower plenum, and the air flow into the discharge plenum is in an upwards direction, the invention is suitable for embodiments having different flow paths. For example, in some ovens, the blower scroll 24 and its associated plenum 22 may be located above the internal volume 14 and the air flow through the discharge plenum 28 may be in a downward direction rather than an upward direction. As described in more detail with respect to FIG. 5, the turning vanes of the present invention in such a case can be oriented upside down. Moreover, while the turning vanes in the illustrated embodiments are generally horizontal, and the air flow through the plenums is vertical, the invention is also suitable where the air flow is at other angles (including horizontal), and where the turning vanes may be angled to direct air at another direction (such as vertical). In most embodiments the turning vanes will be oriented in a direction different from the direction of air flow in the discharge plenum and in the illustrated example the vanes direct air at least substantially perpendicular to the direction of air flow in the discharge plenum.

The return ports 18 may be an array of circular openings, spaced evenly in both the horizontal and vertical directions. The discharge ports 32 have conventionally been a array of generally circular and evenly spaced openings, and the invention can be used with discharged ports having that shape. However, the ports 32 can have other shapes, and in some preferred embodiments, the ports 32 may be provided by an array vertical slots.

The shape and size of the parts is selected based on several factors such as the ratio of open area to closed area of the discharge wall. This ratio affects the discharge angle of the discharge jets. The ports 32 are illustrated schematically in FIG. 1. In some embodiments the ports 32 may preferably be vertically elongated directed slots having a narrow width relative to their height.

Figure 2:
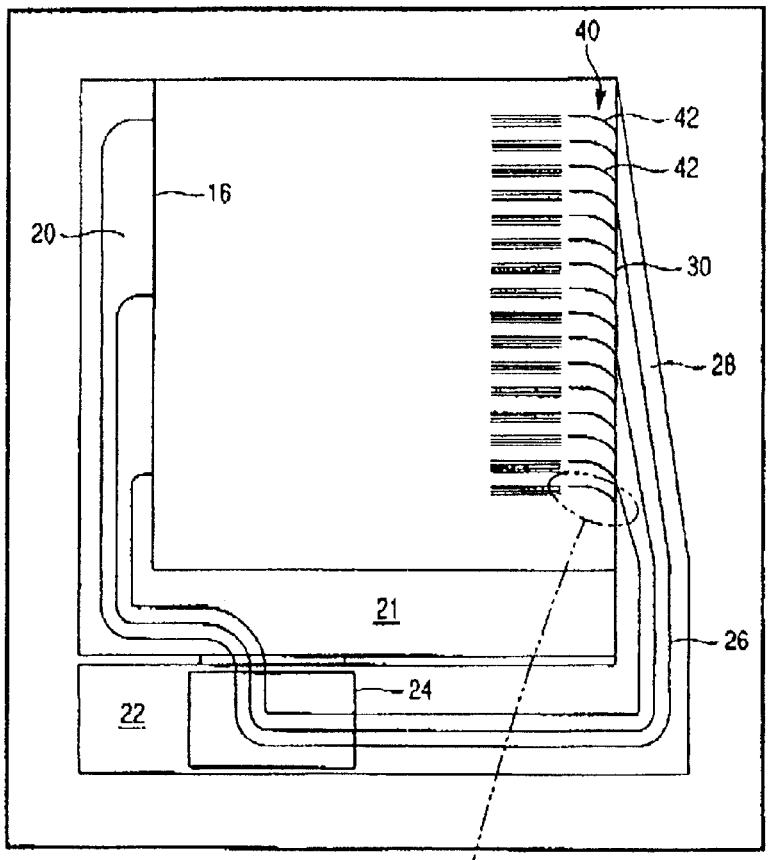
FIG. 2 is a engineering diagram showing a side view of a convention oven having a plurality of turning vanes on a discharge plenum wall.

Turning now to FIG. 2, a turning vane assembly 40 includes a plurality of horizontal vanes 42. As shown in more detail in FIG. 3, each turning vane 42 includes: (1) a curved region 44 that is adjacent to the plenum wall 30, and (2) a substantially horizontal straight region 46. The curved region 44 is shaped on a circular radius and meets the plenum wall 30 at an angle to the plenum wall 30 indicated by the letter A. In some preferred embodiments, it is been found desirable to have a ratio of the length L1 of the straight portion 46 to the length L2 of the curved region 42 being arranged such that L1 divided by L2 gives the value in the range of 0.5 to 0.6. Further, in preferred embodiments it has been found to be desirable for the angle A to be approximately 45 degrees. More specifically, by way of example only, in the case of one embodiment where the discharge ports 32 occupy 15% of the discharge wall area, and the number of discharge ports is 9", and each discharge port has a height of 16" and a width of 0.42", it is been found desirable to use 16 number of turning vanes each having a angle A of 45°, a curved region 44 having a radius of 1.588 inches, and a straight portion having the length of 0.625 inches so that the total extension of the turning vane in the direction perpendicular to the plenum wall 30 is approximately 2.0 inches. In this preferred embodiment, each turning vane is a thin sheet of stainless steel material that can be flexibly bent into the shape shown. For example, in this embodiment, the turning vane has a thickness of 0.031 inches. All dimensions are given by way of example only, and it will be appreciated that the invention can be provided by other dimensions.

Figure 4:
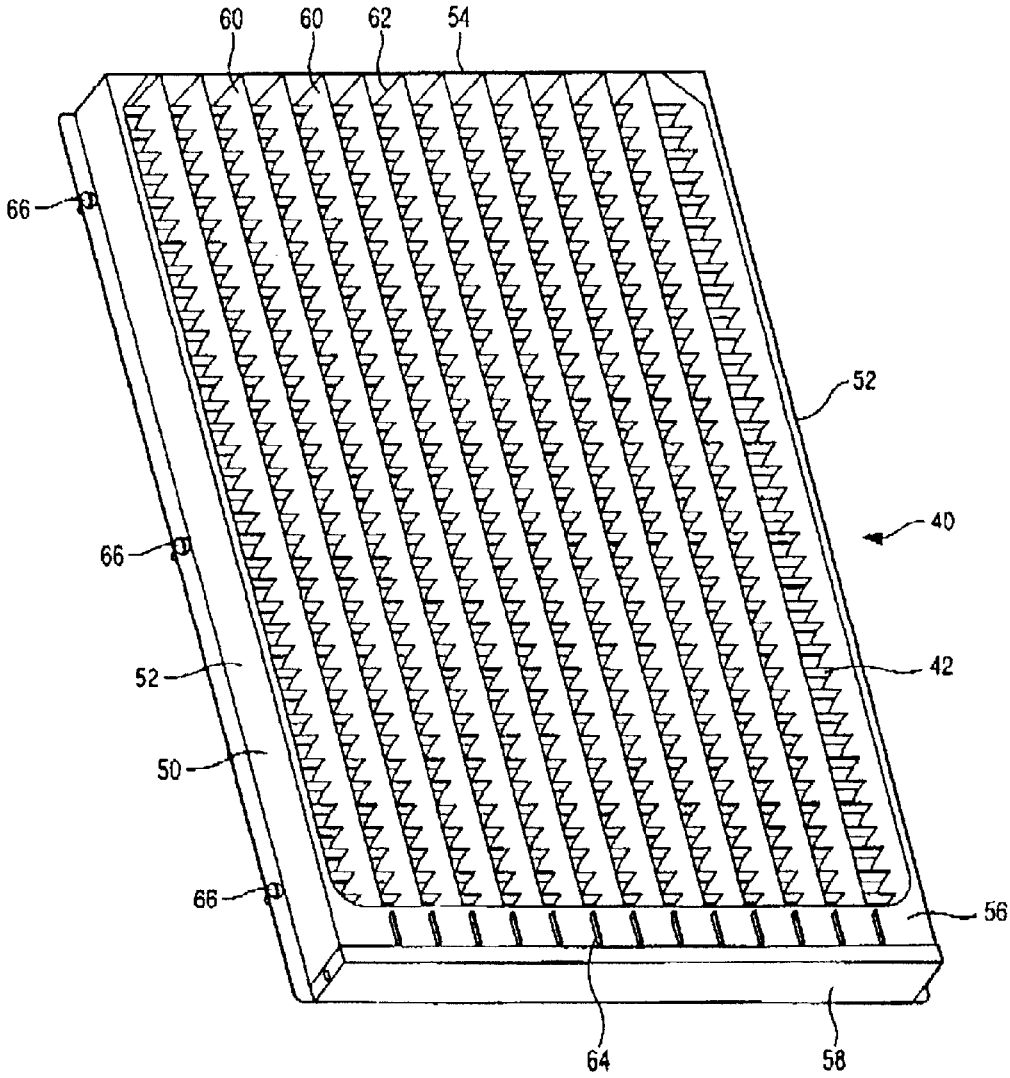
FIG. 4 is an isometric view showing a turning vane assembly including a housing that supports a plurality of turning vanes.

Turning now to FIG. 4, a turning vane assembly 40 is depicted in which a plurality of turning vanes 42 are supported within a framework 50.

The framework 50 includes a perimeter box-shaped structure, having two longitudinal side walls 52, an end wall 54 and a top wall 56. An end cap 58 is fitted opposite end wall 54 as shown. The turning vanes 42 are held in place by a number of longitudinal slats 60, with each slat 60 having a slot corresponding to the cross sectional shape of each turning vane 42 so that the slats support the vanes 42. The slats 60 are retained in the framework 50 by: (1) end tabs 62 that project into complementary slots in the end wall 54; and (2) side tabs 64 that project into complementary slots in the top wall 56.

Figure 3:
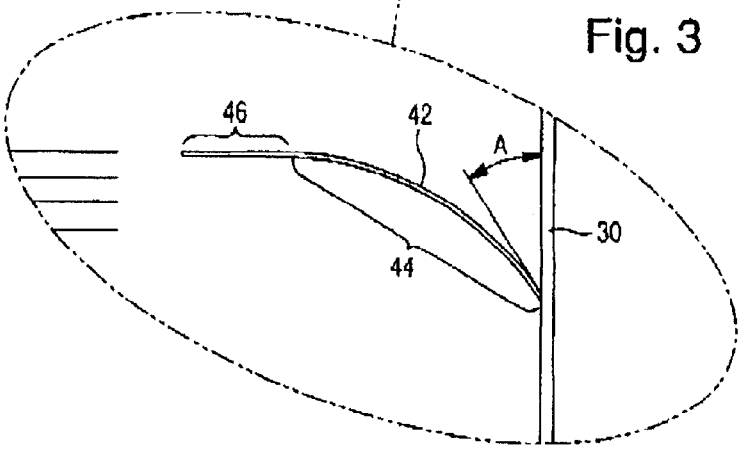
FIG. 3 is a detailed view showing a turning vane in a detail region of FIG. 4.

Still referring to FIG. 4, the method of assembly of a preferred embodiment is as follows. First, all of the slats 60 are installed into the framework 50. At this point, the framework 50 is supporting all of the slats 60 in a parallel arrangement and the end cap 58 is fitted. Next, the turning vanes 42 are installed one by one into the assembly. Most specifically, each turning vane 42 is aligned with a horizontal row of slots in the slats 60, and is slid into the slots. The turning vanes originally may be flat, or may have some degree of precurvature introduced to them (for example by rolling the vanes 42 over a curved pipe or other curved surface). As noted above, the vanes 42 are thin and relatively flexible, and therefore as they slide into the curved slots on the slats 60, the vanes 42 adopt their final shape as shown in FIG. 3. Once all of the horizontal vanes 42 have been slid fully into their slots, the vanes 42 have some degree of a frictional fit within their slots in the slats 60, and hence the vanes 42 do not tend to fall out. The assembly is then mounted to the discharge plenum wall and is fastened to the wall by fasteners 56.

Figure 5:
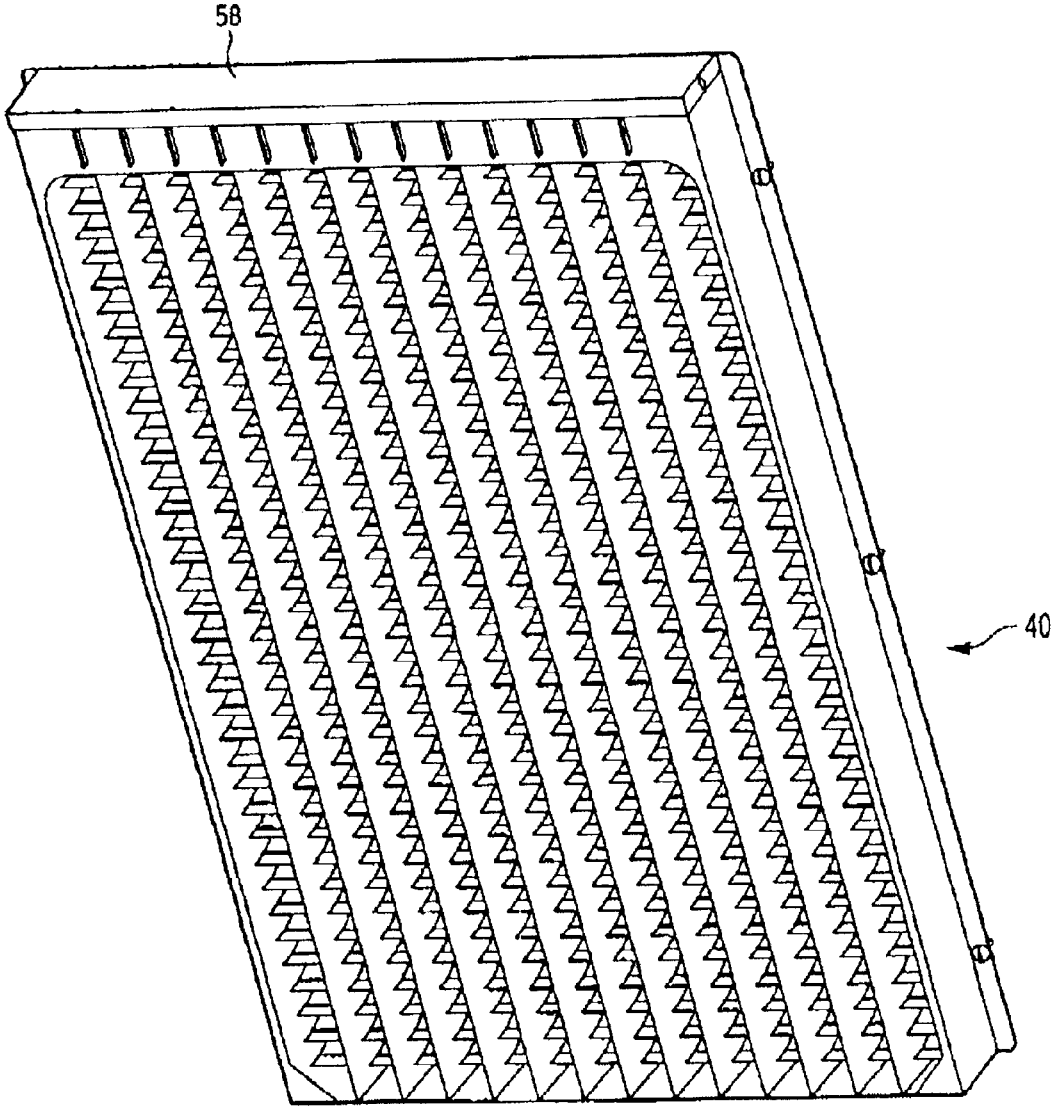
FIG. 5 is an isometric view showing an alternative embodiment of the arrangement of FIG. 4.

FIG. 4 illustrates an embodiment that is used with upward airflow in the discharge plenum. The cap 58 is illustrated at the bottom of the assembly, although it may be alternatively be located at the top. FIG. 5 illustrates an alternative embodiment, having the cap 58 at the top, but having the vanes oriented upside down compared to FIG. 4. This embodiment of FIG. 5 is useful for a discharge plenum having downwardly flowing air. The actual fluid flow direction after exiting the vanes is determined in several factors including (1) a fluid discharge angle that could result from the dimensions of the plenum and discharge ports, and (2) the direction after being influenced by the vanes.

From the foregoing exemplary embodiments, it can be seen that the invention provides embodiments that permit air to be directed in a predetermined direction from a two dimensional porous surface, (e.g. a plenum discharge wall) when air is being supplied behind that surface in a direction different than the predetermined direction (e.g. in a plenum). For example, in the illustrated embodiment the air is being supplied behind the plenum surface in a direction parallel or nearly parallel to the plenum surface, and after exiting through the plenum ports, it is now directed by the vanes in a direction generally or substantially perpendicular to the plenum surface. Although in the illustrated embodiment, the flow behind the plenum wall is in a first direction, and the air flow provided by the turning vanes is in a second direction generally perpendicular to the first direction, the invention may also be used to direct air at any predetermined angle, and the predetermined discharge angle may have any relationship to the angle of air flow occurring on the other side of the plenum wall.

The actual fluid flow direction after exiting the vanes is determined by several factors including (1) a first discharge angle that results from e.g. the dimensions of the plenum and discharge parts, and (2) the air flow direction that results after being influenced by the vanes.

The illustrated embodiment is used with a convection oven, such as a batch or conveyor oven. However, the invention may be utilized in other types of environmental chambers such as refrigerators, and may be used with other systems including for example other duct systems, to provide uniform fluid direction and/or velocity. A particular benefit of some embodiments of the invention is that a compact duct system may be used and still supply the fluid uniformly in one or more predetermined directions over a wide area.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus for use with a porous discharge wall having a first side and a second side, with a fluid flowing on the first side generally in a first direction, the apparatus comprising:

a plurality of substantially parallel vane members located proximate the second side of the discharge wall and each having a profile that has a first curved portion proximate the discharge wall and a second substantially straight portion distal from the discharge wall that directs the discharge fluid from the second side in a predetermined second direction.

2. An apparatus according to claim 1, wherein the fluid is air.

3. An apparatus according to claim 1, wherein the second direction is different from the first direction.

4. An apparatus according to claim 1, wherein the porous wall has rows of discharge openings, and respective vanes of said plurality of vanes are each disposed adjacent to one respective row of discharge openings.

5. An apparatus according to claim 1, wherein each said vane has a first end adjacent to the discharge wall.

6. An apparatus according to claim 1, wherein each said vane has a first end abutting the discharge wall.

7. An apparatus according to claim 6, wherein each said vane has a second end extending in the second direction.

8. An apparatus according to claim 1, wherein the second direction is substantially perpendicular to the discharge wall.

9. An apparatus according to claim 1, wherein the second direction is substantially perpendicular to the first direction.

10. An apparatus according to claim 1, wherein the discharge wall is a wall with an elongated plenum an the first side thereof.

11. An air handling apparatus, comprising:

a chamber having a first porous side wall for supplying fluid to the chamber and a second porous side wall opposed to the first porous side wall for returning fluid from the chamber;

a plenum supplying fluid moving in a first direction to the first porous wall permitting fluid flow from said first porous wall via an exit side of said first porous wall; and a plurality of substantially parallel vane members located on said exit side of said first porous wall that directs exiting fluid flow in a predetermined second direction, toward said opposed second porous side wall, said vane members each having a profile that has a first curved portion proximate the exit side of the first porous wall and a second substantially portion distal from the exit side.

12. An apparatus according to claim 11, wherein the fluid is air.

13. An apparatus according to claim 11, wherein the second direction is different from the first direction.

14. An apparatus according to claim 11, wherein the porous plenum wall has rows of discharge openings, and respective vanes of said plurality of vanes are each disposed adjacent to one respective row of discharge openings.

15. An apparatus according to claim 11, wherein each said vane has a first end adjacent to said wall.

16. An apparatus according to claim 11, wherein each said vane has a first end abutting said wall.

17. An apparatus according to claim 11, wherein each said vane has a second end extending in the second direction.

18. An apparatus according to claim 11, wherein the second direction is substantially perpendicular to said wall.

19. An apparatus according to claim 11, wherein the second direction is substantially perpendicular to the first direction.

20. An apparatus for use with an oven having a first porous discharge wall for supplying fluids to a chamber and having a first side and a second side, with a fluid flowing on the first side generally in a first direction, and the oven having a return wall opposed to said first wall for returning fluid from the chamber, apparatus comprising:

means located proximate the second side of the discharge wall for directing the discharge fluid from the second side in a predetermined second direction in a direction substantially towards the opposed return wall; and means for supporting said directing means.

21. An apparatus according to claim 20, wherein the fluid is air.

22. An apparatus according to claim 20, wherein the second direction is different from the first direction.

23. An apparatus according to claim 20, wherein said directing means comprises at least one vane member.

24. An apparatus according to claim 20, wherein said directing means comprises a plurality of vane members.

25. A method for use with an oven having a first porous wall for supplying fluid to a chamber, the first wall having a first side and a second side, comprising the steps of:

supplying a fluid on the first side generally in a first direction;

receiving fluid at a return wall opposed to the discharge wall; and directing discharge fluid from the second side in a second direction using at least one vane member, said second direction being substantially towards the opposed return wall, wherein the directing step includes providing a plurality of the vane members adjacent to the second side of the wall, each vane member having a profile that has a first curved portion proximate the second side and a second substantially straight portion distal from the second side.

* * * * *